US009238258B2

(12) United States Patent
Hanada et al.

(10) Patent No.: US 9,238,258 B2
(45) Date of Patent: Jan. 19, 2016

(54) METHOD FOR PRODUCING DOUBLE-WALL TUBE WITH BRAIDED WIRES AT ITS INTERFACE

(75) Inventors: Takuya Hanada, Tokyo (JP); Takashi Nakashima, Tokyo (JP); Tetsuo Yokoyama, Tokyo (JP); Kouichi Kuroda, Tokyo (JP); Tatsuya Okui, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 316 days.

(21) Appl. No.: 13/878,275

(22) PCT Filed: Oct. 17, 2011

(86) PCT No.: PCT/JP2011/005779

§ 371 (c)(1),
(2), (4) Date: Apr. 8, 2013

(87) PCT Pub. No.: WO2012/053172

PCT Pub. Date: Apr. 26, 2012

(65) Prior Publication Data

US 2013/0205861 A1 Aug. 15, 2013

(30) Foreign Application Priority Data

Oct. 18, 2010 (JP) ..... 2010-233629

(51) Int. Cl.

| | |
|---|---|
| ***B21C 1/22*** | (2006.01) |
| ***B21C 37/15*** | (2006.01) |
| ***F28F 1/00*** | (2006.01) |

(52) U.S. Cl.

CPC ..... *B21C 1/22* (2013.01); *B21C 37/154* (2013.01); *F28F 1/003* (2013.01)

(58) Field of Classification Search

CPC ..... B21C 1/16; B21C 1/18; B21C 1/22; B21C 37/154; B21C 37/15; B21D 39/04; B21D 53/02

See application file for complete search history.

(56) References Cited

U.S. PATENT DOCUMENTS

| | | | | |
|---|---|---|---|---|
| 3,125,806 | A * | 3/1964 | Cameron | 29/520 |
| 4,125,924 | A * | 11/1978 | Goetze et al. | 29/895.21 |
| 4,419,802 | A * | 12/1983 | Riese | 29/890.036 |

FOREIGN PATENT DOCUMENTS

| | | |
|---|---|---|
| JP | 6-257986 | 9/1994 |
| JP | 9-119791 | 5/1997 |
| JP | 10-43813 | 2/1998 |
| JP | 10-82501 | 3/1998 |
| JP | 2724169 | 3/1998 |

* cited by examiner

*Primary Examiner* — Debra Sullivan
(74) *Attorney, Agent, or Firm* — Clark & Brody

(57) ABSTRACT

Provided is a method for producing a double-wall tube with braided wires at its interface in which the braided wires are interposed between an outer-wall and inner-wall blank tubes and then a drawing process is applied so as for the braided wires to be brought into close contact with the inner surface of the outer-wall tube and the outer surface of the inner-wall tube, the method comprising: polishing the inner surface of the outer-wall blank tube and the outer surface of the inner-wall blank tube so that a surface roughness thereof satisfies Ra<1.0 μm, followed by interposing the braided wires between the outer-wall and inner-wall blank tubes; performing a sinking drawing process so that the difference of the outer diameter of the resulting double-wall tube relative to a die bore diameter is 0.1 mm to 0.3 mm; and subsequently performing heat treatment. The double-wall tube produced is suitable as a heat-transfer tube.

4 Claims, 6 Drawing Sheets

(a)

(b)

(c)

(a)

(b)

(c)

METHOD FOR PRODUCING DOUBLE-WALL TUBE WITH BRAIDED WIRES AT ITS INTERFACE

TECHNICAL FIELD

The present invention relates to a method for producing a double-wall tube with braided wires at its interface to be used for a steam generator of a fast reactor.

The definition of "a double-wall tube with braided wires at its interface" in the present description is as follows unless otherwise specified.

[Double-wall tube with braided wires at its interface]: as being defined by a double-wall tube with braided wires at its interface which is produced in such a manner that the braided wires are interposed between an inner-wall and outer-wall blank tubes, followed by a drawing process, so that the braided wires are brought into close contact with the outer surface of an inner-wall tube and the inner surface of an outer-wall tube. The "braided wires" denote, for example, a porous body formed by winding, around the outer surface of the inner-wall tube, braided wires consisting of a number of thin wires.

BACKGROUND ART

In a fast reactor plant, elevated-temperature liquid metal sodium which has been used to cool the inside of a nuclear reactor is introduced to a steam generator where heat is exchanged with that of water to generate steam. In this case, a tube material of double-wall structure (double-wall tube) in which an outer-wall tube and an inner-wall tube are mechanically brought into close contact with each other is used as a heat-transfer tube constituting the above-mentioned steam generator. It is for the following two reasons that the double-wall tube is used as the heat-transfer tube constituting the steam generator.

One reason is that the double-wall tube is excellent in cracking resistance. Within the steam generator, water is passed through the inside of the heat-transfer tube, while liquid metal sodium travels around the outside thereof. At that time, if a crack penetrated through in thickness direction occurs in the heat-transfer tube, the liquid metal sodium should contact with the water to cause an extremely dangerous explosive reaction.

In a solid tube material of a single wall structure, a surface defect generated on either the inner surface or outer surface thereof is apt to propagate to the other surface, causing a crack penetrated through in a thickness direction. On the other hand, in the double-wall tube in which the inner-wall tube and the outer-wall tube are only mechanically joined to each other, there is no risk that a crack generated on a wall surface is immediately propagated to the other wall surface to form a crack penetrated through both the thicknesses of the inner- and outer-wall tubes. Therefore, the double-wall tube excellent in cracking resistance is used as the heat-transfer tube constituting the steam generator.

The other reason is that the failure of the double-wall tube can be detected at an early stage. In the use of the double-wall tube as the heat-transfer tube constituting the steam generator, if a crack occurs in either the inner-wall tube or the outer-wall tube, a leaked fluid due to the crack is oozed to a tube end through a small gap between the outer-wall tube and the inner-wall tube. This leaked fluid to the tube end is detected, whereby the failure of the double-wall tube can be detected at an early stage.

However, in a double-wall tube simply composed of a smooth-surface outer-wall tube and a likewise inner-wall tube in which a gap between the two tubes is as narrow as a few microns, the detection of the crack is delayed since it takes long time until the leaked fluid is oozed to the tube end after the occurrence of the crack. On the other hand, the use of the double-wall tube as the heat-transfer tube requires excellent heat conductivity without a gap between the outer-wall tube and the inner-wall tube.

Therefore, a large number of proposals are made with respect to a double-wall tube configured to secure a flow passage for a leaked fluid between an inner-wall tube and an outer-wall tube by interposing a porous layer between the two tubes and to enhance the degree of contacting of the porous layer or secure excellent heat conductivity by sufficiently bringing the porous layer into close contact with the inner surface of the outer-wall tube and the outer surface of the inner-wall tube, and a method for producing the same.

For example, a method for producing a double-wall tube for a fast-breeder reactor is proposed in Patent Literature 1, wherein a porous metal layer interposed between an inner-wall tube and an outer-wall tube is surely brought into close contact with one or both of the inner-wall and outer-wall tubes by heat-treating a double-wall tube obtained by interposing an insert material between the mating surfaces of the porous metal layer and the inner-wall and outer-wall blank tubes, followed by diameter reduction after air-tightly sealing the mutually mating surfaces of the inner-wall and outer-wall tubes at both ends of the tube.

In Patent Literature 2, a double-wall heat-transfer tube for a steam generator is disclosed, in which the filling rate of a porous metal to a gap portion between an outer-wall and an inner-wall blank tubes is set in a range of 70% to 95%, a surface roughness of at least either the inner surface of the outer-wall blank tube or the outer surface of the inner-wall blank tube before double-wall-tube processing is set in a range of 0.5 μm to 1.6 μm and, further, the porous metal is constituted by braiding a plurality of thin wires differed in wire diameter. For obtaining this double-wall heat-transfer tube, a method for producing a double-wall heat-transfer tube is also disclosed therein, in which an outer-wall blank tube and an inner-wall blank tube are solid-phase diffusion bonded to a porous metal respectively by performing heat treatment while holding a gap portion, surrounded by the outer-wall tube, the inner-wall tube with an interposed porous metal, under vacuum.

In Patent Literature 3, a heat-transfer tube for a steam generator which is excellent in both crack detecting performance and heat transfer performance is disclosed, in which the heat-transfer tube includes an inner-wall tube and an outer-wall tube composed of iron-based alloy, and a porous body excellent in heat conductivity and having a porosity of 3%≥, which is interposed between the two tubes, and the porous body is bonded to the inner-wall tube and the outer-wall tube through metal coating layers formed respectively on the outer surface of the inner-wall tube and the inner surface of the outer-wall tube. As a method for producing this heat transfer tube, a method for producing a heat-transfer tube for a steam generator is also disclosed therein, in which the porosity of a porous body to be inserted between an inner-wall blank tube and an outer-wall blank tube is set to 30% or more, the reduction rate of drawing is set to 70% or less, or metal coating layers are preliminarily formed respectively on the outer circumferential surface of the inner-wall blank tube and the inner circumferential surface of the outer-wall blank tube by means of electroplating or the like.

In Patent Literature 4, a method for producing a double-wall heat-transfer tube is disclosed, the method comprising the steps of; inserting, into an outer-wall blank tube, an inner-wall blank tube with a ceramic coating layer formed on the outer surface, the inner-wall blank tube being enhanced in heat conductivity by reducing the thickness of the coating layer; and generating, in the ceramic coating layer, a crack that forms a leak detection flow path for fluid to be heated while plastically deforming the inner-wall blank tube by a tube expanding process.

However, the producing of each of these conventional double-wall tubes with a porous body interposed between an inner-wall tube and an outer-wall tube requires respective specific producing processes for maintaining the porosity for securing the flow path for a leaked fluid and for maintaining satisfactory heat conductivity.

Namely, the method described in Patent Literature 1 requires the steps of interposing the insert material between the mating surfaces of the porous metal layer and each of the inner-wall and outer-wall blank tubes and performing diameter reduction by use of a plug. The method described in Patent Literature 2 requires the specification of the filling rate of the porous metal to the gap portion between the outer-wall and the inner-wall blank tubes and the surface roughness of the inner surface of the outer-wall blank tube and the outer surface of the inner-wall blank tube prior to a double-wall tube processing, and further the treatment in vacuum for the solid-phase diffusion bonding. The method described in Patent Literature 3 requires the specification of the porosity of the porous body and the reduction rate of drawing, or the preliminary formation of the metal coating layers on the outer circumferential surface of the inner-wall blank tube and the inner circumferential surface of the outer-wall blank tube by electroplating or the like. The method described in Patent Literature 4 requires processes for the formation of the ceramic coating layer on the inner-wall blank tube surface by PVD or CVD, and the formation of the crack in the coating layer by the tube expanding process of the inner-wall blank tube.

CITATION LIST

Patent Literature

PATENT LITERATURE 1: Japanese Patent Application Publication No. 10-82501

PATENT LITERATURE 2: Japanese Patent Application Publication No. 9-119791

PATENT LITERATURE 3: Japanese Patent No. 2724169

PATENT LITERATURE 4: Japanese Patent Application Publication No. 6-257986

SUMMARY OF INVENTION

Technical Problem

In view of the above-mentioned situation in the producing of such a double-wall tube including a porous body interposed between an inner-wall tube and an outer-wall tube, the present invention has an object to provide a method for efficiently producing a double-wall tube with braided wires at its interface, which can secure excellent heat conductivity by sufficiently bringing the braided wires into close contact with the inner surface of the outer-wall tube and the outer surface of the inner-wall tube in addition to a flow path for a leaked fluid between the outer-wall tube and the inner-wall tube, by a simple means without resorting to a special process.

Solution To Problem

The summaries of the present invention are as follows.

(1) A method for producing a double-wall tube having braided wires at its interface, including braided wires which are brought into close contact with the inner surface of an outer-wall tube and the outer surface of an inner-wall tube by interposing the braided wires between the outer-wall tube and the inner-wall tube followed by a drawing process, the method comprising: polishing the inner surface of the outer wall tube and the outer surface of the inner-wall tube so that the surface roughness satisfies Ra<1.0 μm in terms of arithmetic average roughness (Ra) prior to interposing the braided wires between the outer-wall tube and the inner-wall tube; performing a sinking drawing so that the difference of the outer diameter of the resulting double-wall tube relative to a die bore diameter is 0.1 mm to 0.3 mm; and subsequently performing heat treatment.

The "sinking drawing" means a drawing process without using a plug.

FIG. 1 is a view for illustrating a difference between a die bore diameter and the outer diameter of a double-wall tube after the drawing, process, which is caused during the sinking drawing process. As shown in FIG. 1, when a double-wall tube 1 is made by inserting an inner-wall tube lb into an outer-wall tube la and performing a sinking drawing process in the direction of an outlined arrow, for example, by use of a tapered die 2, the diameter of the double-wall tube 1 does not become the same as the die bore diameter but becomes generally smaller since the inner surface of the tube is not constrained by a plug. The above-mentioned "difference of the outer diameter of the double-wall tube relative to the die bore diameter, which results from a sinking drawing process" means a difference d obtained by subtracting the outer diameter Dp of the double-wall tube after the sinking drawing process from the die bore diameter Dd in FIG. 1. The difference d of the outer diameter of the double-wall tube after the sinking drawing process relative to the die bore diameter is also referred to as "an amount of sinking in outer diameter of double-wall tube" or simply "an amount of sinking in diameter" herein.

(2) The method for producing a double-wall tube having braided wires at its interface according to (1), wherein a tapered die having an included angle of 25° to 30° is used as a processing die.

(3) The method for producing a double-wall tube having braided wires at its interface according to (1) or (2), wherein 9Cr-1Mo steel (e.g., "fossil-power-dedicated" STBA 28 based on Thermal Power Plant Standard or ASME SA-213 Gr. T91) is used for the outer-wall tube, inner-wall tube and braided wires.

In the present description, the "Thermal Power Plant Standard" mean a technical standard for a thermal power generating plant.

Advantageous Effects of Invention

According to the method for producing a double-wall tube having braided wires in its interface of the present invention, the double-wall tube with braided wires at its interface which can secure excellent heat conductivity in addition to a flow path for a leaked fluid between an outer-wall tube and an inner-wall tube since the braided wires (porous body) are sufficiently in close contact with the outer-wall tube and the inner-wall tube can be efficiently produced by a simple process. This double-wall tube with braided wires in its interface is suitable as a starting material of a heat-transfer tube for a steam generator of a fast reactor.

DESCRIPTION OF EMBODIMENTS

Figure 1:
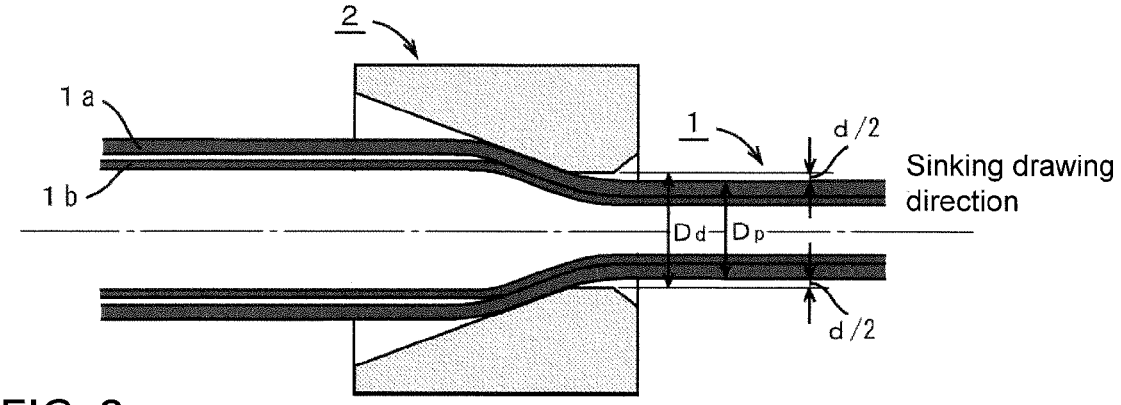
FIG. 1 is a view for illustrating a difference between a die bore diameter and the outer diameter of a double-wall tube after a drawing, process, which is caused by a sinking drawing process.

The present inventors examined for a method capable of efficiently producing a double-wall tube with braided wires at its interface by a simple process while solving the above-mentioned problem. As a result, it was found that the braided wires can be sufficiently brought into contact with the outer-wall tube and the inner-wall tube at both the interfaces between the outer-wall tube and the braided wires and between the braided wires and the inner-wall tube in such a manner that by preparing the inner surface of the outer tube and the outer surface of the inner tube into a predetermined surface roughness by polishing prior to assembling blank outer-wall and inner-wall blank tubes, and by subjecting an assembled tube to a sinking drawing process so that the difference of the actual outer diameter of the double-wall tube after the drawing relative to the die bore diameter is 0.1 mm to 0.3 mm.

It is also found that when a taper die having an included angle of 25°-30° is used, the degree of close contact in between can be enhanced by the sinking drawing process to further promote the secure contact in both the interfaces between the outer-wall tube and the braided wires and between the braided wires and the inner-wall tube.

The present invention is achieved based on the above-mentioned findings.

As described above, the method for producing a double-wall tube with braided wires at its interface of the present invention is based on the premise that the braided wires are brought into close contact with the outer surface of the inner-wall tube and the inner surface of the outer-wall tube by performing a drawing process after interposing the braided wires between the inner-wall blank tube and the outer-wall blank tube.

This is in order to obtain a double-wall tube which can secure, when applied to a heat-transfer tube of a steam generator for a fast reactor, a flow path for a leaked fluid between an outer-wall tube and an inner-wall tube in the event of a crack to allow early detection of the crack, and also secure excellent heat conductivity by interposing the braided wires between the inner-wall tube and the outer-wall tube.

A method for interposing the braided wires between the inner-wall tube and the outer-wall tube includes the following method. Namely, a sheet-like net braided in a desired mesh by use of a small-diameter wire rod is molded into a cylinder, and this cylinder is inserted between the inner-wall blank tube and the outer-wall blank tube, or the sheet-like net is spirally wound around the outer surface of the inner-wall blank tube, and the resulting inner-wall blank tube is inserted into the outer-wall blank tube.

Under such a premise, the method for producing a double-wall tube with braided wires of the present invention comprises: polishing the inner surface of an outer-wall blank tube and the outer surface of an inner-wall blank tube so that surface roughness satisfies Ra<1.0 μm, performing a sinking drawing process so that the difference of the outer diameter of the resulting double-wall tube relative to the die bore diameter is 0.1 mm to 0.3 mm, and subsequently performing heat treatment.

The polishing of the inner surface of the outer-wall blank tube and the outer surface of the inner-wall blank tube can be performed, for example, by use of a roller type polishing device for the tube outer surface and by use of an inner surface polishing device configured to reciprocate a plug with abrasive paper inside a tube for the tube inner surface.

In the present invention, the reason for performing a sinking drawing process after the predetermined polishing preparation is that the sinking drawing step can be simplified to enhance the efficiency of production. In that case, the difference of the actual outer diameter of the double-wall tube after the drawing process relative to the die bore diameter (an amount of sinking in diameter) is set to 0.1 mm or more. By performing the drawing process while maintaining an amount of sinking in diameter within this range, interfaces each between the outer-wall tube and the braided wires and between the braided wires and the inner-wall tube can be sufficiently brought into close contact with each other, in combination with the effect by the heat treatment of the subsequent step, to secure the satisfactory heat conductivity as double-wall tube.

On the other hand, an amount of sinking in diameter is set to 0.3 mm or less. If an amount of sinking in diameter should exceed the criteria, a strong tensile stress is applied in the longitudinal direction of a drawing object material to increase the probability of fracture of the drawing object material.

The sinking reduction amount is determined depending on the tube outer diameter, the die bore diameter, the degree of processing and the like, and the above-mentioned condition: "0.1 mm≤an amount of sinking in diameter≤0.3 mm" can be maintained by properly selecting them. The outer diameter of the double-wall tube as the object of the present invention is 15 to 40 mm.

Although a plug drawing process, for example, instead of the sinking, the drawing process also promises the secure close contact with an increased degree of contact of the interfaces, the sinking drawing process allows largely improved production efficiency since the preparation of a plug and its handling are dispensed with, and the step and operation of lubricating the inner and outer surfaces of an assembled steel tube can be omitted.

As the die used for a sinking drawing process, a taper die having an included angle of 25° or more is preferred. In this case, it is further preferred to use a taper die having an included angle of 30° or less.

Figure 2:
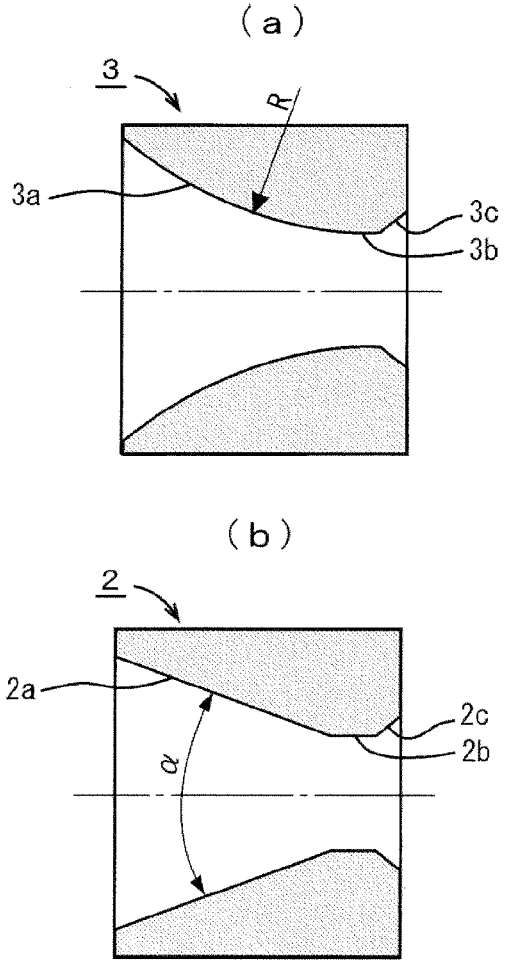
FIGS. 2 are views showing longitudinal sectional shapes of processing dies used for the cold drawing process, wherein (a) is an R die and (b) is a taper die.

FIGS. 2 are views showing longitudinal sectional shapes of processing dies used for cold drawing processing, wherein (a) is an R die, and (b) is a taper die. The R die 3 shown in (a) of the same figure includes an approach portion 3*a* for guiding a tube material to the center of a die bore, the approach portion having an inside diameter reduced toward the center; an outlet-side bearing portion 3*b* for determining a processing shape of the tube material, the bearing portion having a constant inside diameter; and a relief 3*c*. The shape of the approach portion of the R die is defined by curvature radius R.

The taper die 2 shown in FIG. 2(*b*) includes an approach portion 2*a* for guiding a tube material to the center of a die bore, the approach portion having an inside diameter reduced toward the center; an outlet-side bearing portion 2*b* for determining a processing shape of the tube material, the bearing portion having a constant inside diameter; and a relief 2*c*. The shape of the approach portion of the tapered die is defined by an included angle α.

Figure 3:
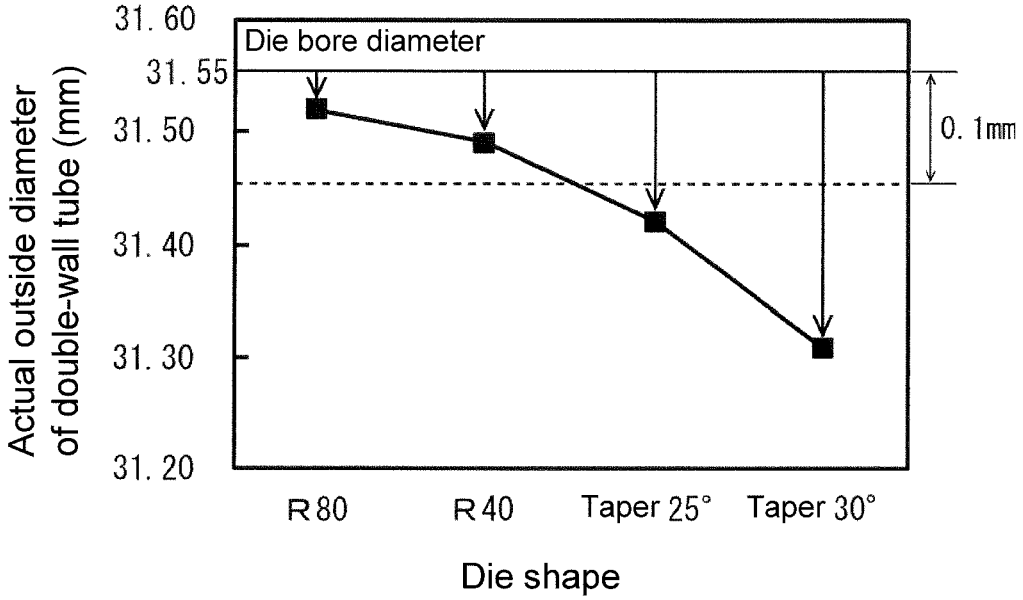
FIG. 3 is a view typically showing a measurement result for the actual outer diameter of a double-wall tube having cylindrical braided wires interposed between an inner-wall tube and an outer-wall tube, after a drawing (sinking) process using variously-shaped dies.

FIG. 3 is a view typically showing a measurement result for the actual diameter of a double-wall tube with cylindrical braided wires interposed between an inner-wall tube and an outer-wall tube after a sinking drawing process using variously-shaped dies. The dies being used therein are an R die having a curvature radius of 80 mm (indicated R80 in FIG. 3), an R die having a curvature radius of 40 mm (indicated R40 similarly), a taper die having an included angle of 25° (indicated Taper 25° similarly) and a taper die with an included angle of 30° (indicated Taper 30° similarly). Each of the dies had the same die bore diameter of 31.55 mm. The length of each downward arrow in FIG. 3 shows an amount of sinking in diameter.

As being evident from FIG. 3, an amount of sinking in diameter can be increased more when a taper die is used than when an R die is used if the both have the same die bore diameter. In the use of taper dies, the difference of the actual outer diameter of the double-wall tube relative to the die bore diameter (31.55 mm)—an amount of sinking in diameter—satisfies the condition: "an amount of sinking in diameter ≥0.1 mm or more". In contrast to this, in the case of R dies with curvature radius of 80 mm to 40 mm, an amount of sinking in diameter was less than 0.1 mm.

With respect to these resulting double-wall tubes, cross-sections thereof were observed under an optical microscope after going through the heat treatment step. As a result, as described in EXAMPLES to be described later, a positively close contact is sufficiently brought in both the interfaces between the outer-wall tube and the braided wires and between the braided wires and the inner-wall tube in the use of the dies of Taper 25° and Taper 35° which satisfy the condition: "an amount of sinking in diameter ≥0.1 mm", while the positive contact was not sufficiently brought in the use of the dies of R80 and R40 with an amount of sinking in diameter being less than 0.1 mm.

In the method for producing a double-wall tube with braided wires at its interface of the present invention, an embodiment using a tapered die having an included angle of 25° to 30° is desirably adopted as a processing die. This is because that when the taper included angle is 25° or more, the condition: "an amount of sinking in diameter being 0.1 mm or more" can be relatively easily satisfied as shown in FIG. 3.

On the other hand, when the taper included angle exceeds 30°, a strong tension force is applied in a longitudinal direction of a workpiece to increase the probability of fracture of the workpiece. Therefore, the upper limit of the taper included angle is set to 30°.

In the method for producing a double-wall tube with braided wires at its interface of the present invention, heat treatment is performed after the sinking drawing process. A secure close contact of the braided wires with the inner surface of the outer-wall tube and the outer surface of the inner-wall tube is promoted by the sinking drawing process which satisfies the above-mentioned predetermined condition (0.1 mm≤an amount of sinking in diameter≤0.3 mm), whereby the secure close contact in both the interfaces between the outer-wall tube and the braided wires and between the braided wires and the inner-wall tube is promoted when the heat treatment is performed.

The heat treatment can be performed in proper conditions according to the material grade of the double-wall tube. For example, when "fossil-power-dedicated" STBA 28, SA-213 Gr. T91 or steel equivalent thereto is used for the inner-wall tube and outer-wall tube, the double-wall tube should be subjected to normalizing in which it is air-cooled after retained at a temperature around 1050° C. for about 30 minutes, and then subjected to tempering in which it is air-cooled after retained at about 780° C. for about 60 minutes.

In the method for producing a double-wall tube with braided wires at its interface of the present invention, it is general to adopt an embodiment using, as the material grade of the outer-wall tube, inner-wall tube and braided wires, 9Cr-1Mo steel ("fossil-power-dedicated" STBA 28, SA-213 Gr. T91) or steel equivalent thereto. As a detailed composition example of the above-mentioned steel grade, for example, "fossil-power-dedicated" STBA 28 has the following composition. Namely, it is a steel containing, in terms of mass%, C: 0.08-0.12%, Si: 0.20-0.50%, Mn: 0.30-0.60%, P≤0.020%, S≤0.010%, Ni≤0.40%, Cr: 8.00-9.50%, Mo: 0.85-1.05%, and V: 0.10-0.25% (the balance being Fe and impurities).

This steel grade is used in a wide range as an alloy steel tube for a boiler and a heat exchanger due to excellent high-temperature characteristics (yield strength, creep strength), and frequently used also in fast reactors. When the material grade of each component of the double-wall tube with braided wires at its interface is such 9Cr-1Mo steel, the producing method of the present invention exhibits the features to the maximum.

EXAMPLES

As the outer-wall blank tube and inner-wall blank tube for the double-wall tube, seamless steel tubes made of "fossil-power-dedicated" STBA 28 were prepared. The dimensions of the respective tubes are as follows.

Outer-wall blank tube: outside diameter 35.8 mm, thickness 3.2 mm, and length 10 m.

Inner-wall blank tube:o outside diameter 24.7 mm, thickness 3.2 mm, and length 10 m.

The inner surface of the outer-wall blank tube and the outer surface of the inner-wall blank tube were polished so that the surface roughness satisfies Ra<1.0 μm, and a net material, which was braided with 44 wires of the same material as the inner-wall blank tube, the wire having an outside diameter of 0.1 mm per bundle, was wound around the outer surface of the inner-wall blank tube to form braided wires. A roller polishing device was used for polishing of the outer surface of the inner-wall blank tube, and an inner surface polishing device was used for polishing of the inner surface of the outer-wall blank tube.

The inner-wall blank tube with the braided wires formed on the outer surface thereof was inserted into the outer-wall blank tube, followed by a sinking drawing process to form a double-wall tube. A taper die with an included angle of 25° (Taper 25°), a taper die with an included angle of 30° (Taper) 30°, an R die with curvature radius of 40 mm (R40) or an R die with curvature radius of 80 mm (R80) were used for the sinking drawing process. Each of the dies had the same die bore diameter of 31.55 mm. An amount of sinking in diameter for the double-wall tube after the drawing was 0.13 mm in the die of Taper 25°, 0.24 mm in the die of Taper 30°, 0.06 mm in the die of R40, and 0.04 mm in the die of R80, respectively.

Thereafter, the above-mentioned double-wall tube was subjected to normalizing of 1,050° C.×30 min and subsequently to tempering of 780° C.×60 min in a bright furnace to form a double-wall tube with braided wires at its interface.

With respect to this double-wall tube with braided wires at its interface, a cross-section of the tube was observed under an optical microscope to confirm the presence or absence of secure close contact in both the interfaces between the outer-wall tube and the braided wires and between the braided wires and the inner-wall tube.

Figure 4:
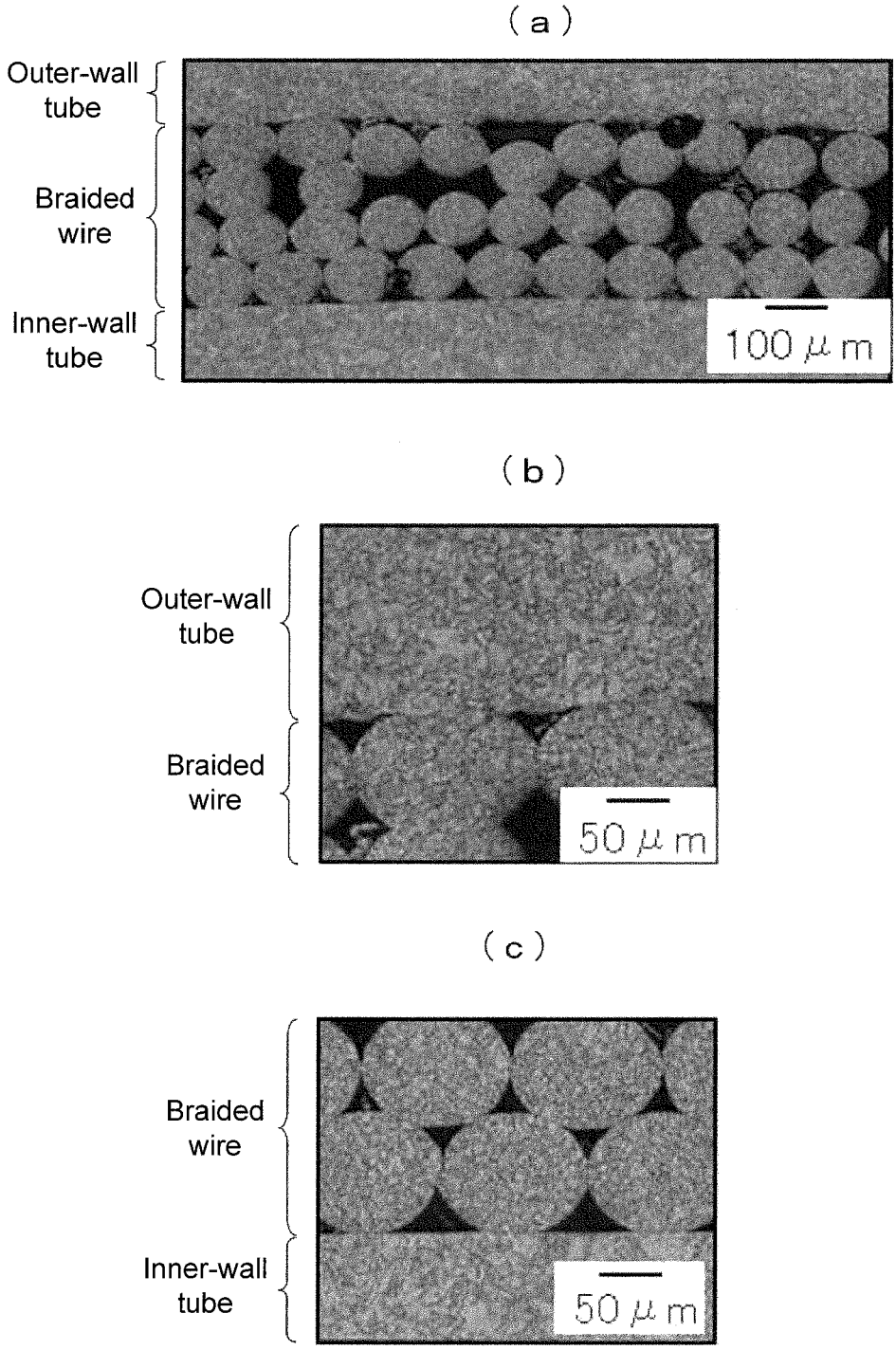
FIGS. 4 are micrographic images of a cross-section of a double-wall tube with braided wires at its interface which is subjected to a sinking drawing process using a taper die having an included angle of 25°.
Figure 5:
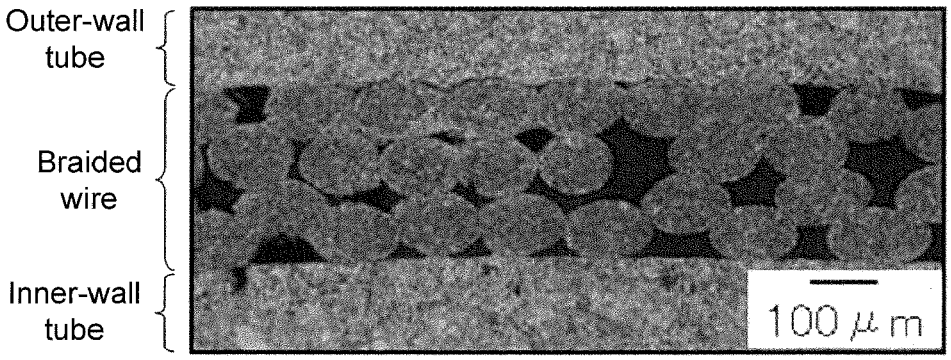
FIGS. 5 are micrographic images of a cross-section of a double-wall tube with braided wires at its interface which is subjected to a sinking drawing process using a taper die having an included angle of 30°.
Figure 5:
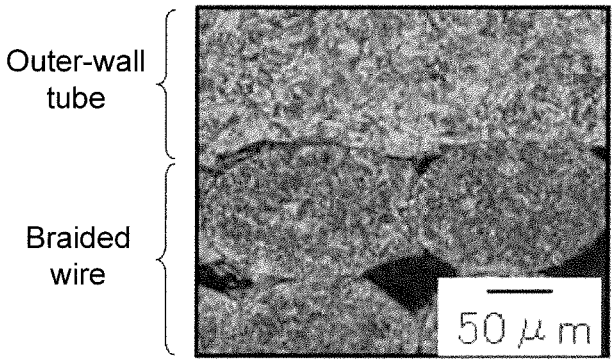
Figure 5:
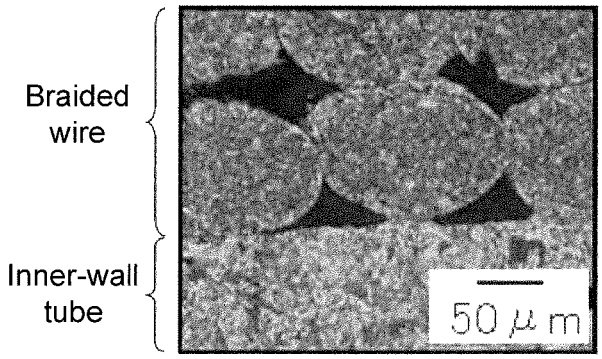
Figure 6:
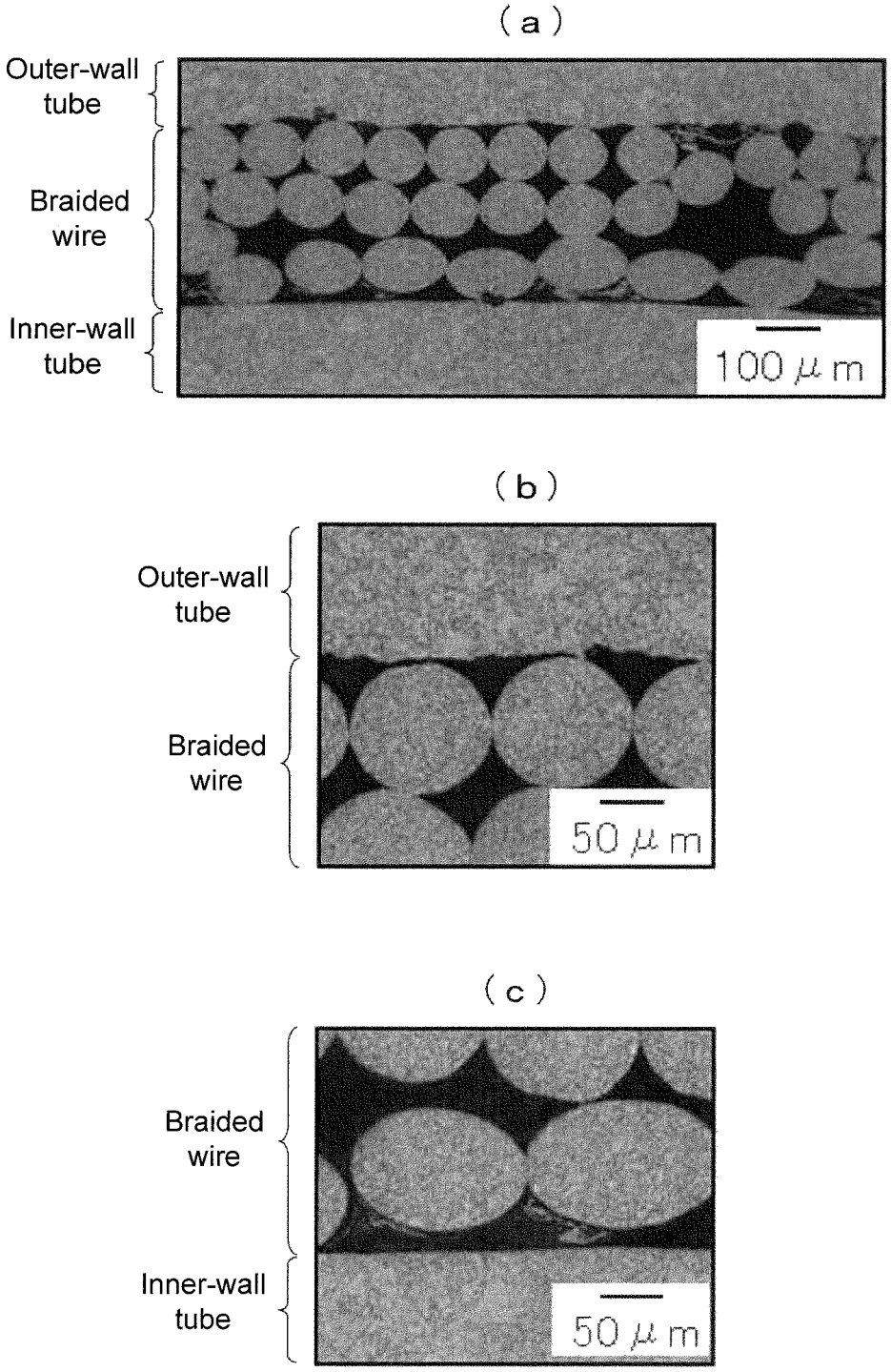
FIGS. 6 are micrographic images of a cross-section of a double-wall tube with braided wires at its interface which is subjected to a sinking drawing process using an R die having a curvature radius of 40 mm.
Figure 7:
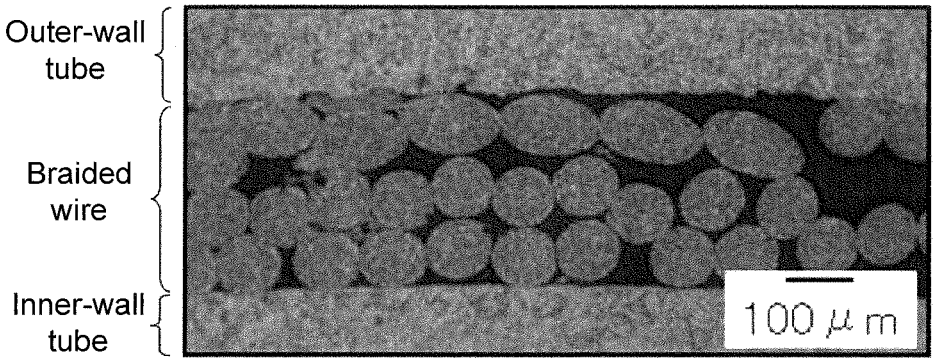
FIGS. 7 are micrographic images of a cross-section of a double-wall tube with braided wires at its interface which is subjected to a sinking drawing process using an R die having a curvature radius of 80 mm.
Figure 7:
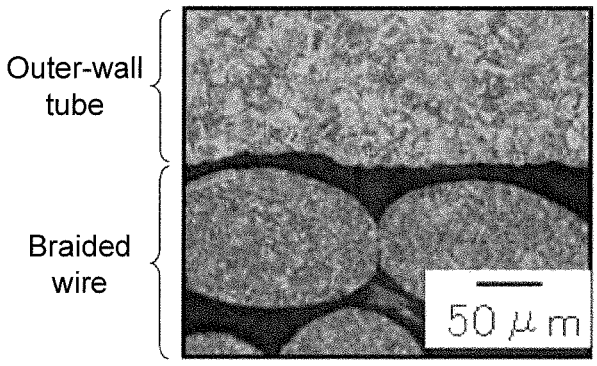
Figure 7:
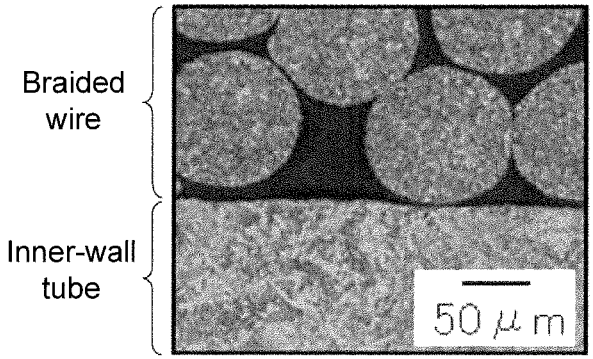

FIGS. 4 to 7 each is a micrographic image of a cross-section of a double-wall tube with braided wires at its interface, wherein the tapered die with an included angle of 25° was used for a sinking drawing process in FIG. 4, the tapered die with an included angle of 30° was used for the sinking drawing process in FIG. 5, the R die with curvature radius of 40 mm was used for a sinking in FIG. 6, and the R die with curvature radius of 80 mm was used for the sinking drawing process in FIG. 7. In each of FIGS. 4 to 7, (a) is an overall photographic image including both the interfaces between outer-wall tube and braided wires and between braided wires and inner-wall tube, (b) is an enlarged photographic image of the interface between outer-wall tube and braided wires, and (c) is an enlarged photographic image of the interface between braided wires and inner-wall tube.

As shown in FIG. 4 or 5, when the tapered die with an included angle of 25° or 30° was used, a number of portions in which braided wires are integrally bonded with the outer-wall tube and/or inner-wall tube were observed in both the interfaces between the outer-wall tube and the braided wires and between the braided wires and the inner-wall tube, and it could be confirmed that the secure contact is sufficiently established therein.

In contrast to this, when the R die with a curvature radius of 40 mm or 80 mm was used, as shown in FIG. 6 or 7, there are not necessarily many portions in which braided wires are integrally bonded with the outer-wall tube and/or inner-wall tube, in both the interfaces between outer-wall tube and braided wires and between braided wires and inner-wall tube, and the secure contact was not fully established.

INDUSTRIAL APPLICABILITY

The method for producing a double-wall tube with braided wires at its interface of the present invention is suitable as a method for producing a source material of a heat-transfer tube constituting a steam generator of a fast reactor, and thus can significantly contribute to this industrial field.

REFERENCE SIGNS LIST

1: Double-wall tube
1*a*: Outer-wall tube
1*b*: Inner-wall tube
2: Tapered die
2*a*: Approach portion
2*b*: Bearing portion
2*c*: Relief
3: R die
3*a*: Approach portion
3*b*: Bearing portion
3*c*: Relief

What is claimed is:

1. A method for producing a double-wall tube with braided wires at an interface thereof comprising:

polishing an inner surface of an outer-wall blank tube and an outer surface of an inner-wall blank tube so that a surface roughness thereof satisfies Ra<1.0 μm in terms of arithmetic average roughness (Ra), interposing the braided wires between the polished outer-wall and inner-wall blank tubes;

performing a sinking drawing process to produce the double-wall tube with the braided wires being brought into close contact with the inner surface of the outer-wall tube and the outer surface of the inner-wall tube, wherein a difference of an outer diameter of the double-wall tube relative to a die bore diameter of a die used in the sinking drawing process is 0.1 mm to 0.3 mm; and subsequently performing heat treatment.

2. The method for producing a double-wall tube according to claim 1, wherein the die is a tapered die having an included angle of 25° to 30° in the sinking drawing process.

3. The method for producing a double-wall tube according to claim 1, wherein 9Cr-1Mo steel is used as a material of each of the outer-wall tube, inner-wall tube and braided wires.

4. The method for producing a double-wall tube according to claim 2, wherein 9Cr-1 Mo steel is used as a material of each of the outer-wall tube, inner-wall tube and braided wires.

* * * * *